US006639563B1

(12) United States Patent
Gu

(10) Patent No.: US 6,639,563 B1
(45) Date of Patent: Oct. 28, 2003

(54) ANTENNA STRUCTURE FOR NETWORK CARD

(76) Inventor: Yin Tsair Gu, No. 90, Yungshin Rd., Hsin Tien (TW)

( * ) Notice: Subject to any disclaimer, the term of this patent is extended or adjusted under 35 U.S.C. 154(b) by 0 days.

(21) Appl. No.: 10/162,648

(22) Filed: Jun. 6, 2002

(51) Int. Cl.[7] ..... H01Q 1/24
(52) U.S. Cl. ..... 343/702; 343/906
(58) Field of Search ..... 343/702, 906; 455/89, 90; 361/736, 737

(56) References Cited

U.S. PATENT DOCUMENTS 5,657,028 A * 8/1997 Sanad ..... 343/700 MS
5,918,163 A * 6/1999 Rossi ..... 455/558
5,943,018 A * 8/1999 Miller ..... 343/702
6,292,148 B1 * 9/2001 Matsuura et al. ..... 343/702
6,359,591 B1 * 3/2002 Mou ..... 343/702
6,437,745 B1 * 8/2002 Vaisanen et al. ..... 343/702
6,456,245 B1 * 9/2002 Crawford ..... 343/702
6,509,876 B1 * 1/2003 Jones et al. ..... 343/702
6,518,927 B2 * 2/2003 Schremmer et al. ..... 343/702

* cited by examiner

*Primary Examiner*—Tan Ho
(74) *Attorney, Agent, or Firm*—Bacon & Thomas, PLLC

(57) ABSTRACT

An antenna structure for network card used with a notebook computer includes an antenna retractably connected to the network card. The antenna is in an open-circuited state when it is at a position retracted in the network card, and in a close-circuited state when it is at a position projected from the network card. The network card can therefore be normally plugged into a network card slot of the notebook computer without the need of removing it from the computer when the latter is not connected to a network or is to be positioned in a bag. The problems of missing network card and of damaged, worn or poor-contacted terminal of the network card due to frequent plugging and unplugging of the network card can therefore be avoided.

2 Claims, 6 Drawing Sheets

ANTENNA STRUCTURE FOR NETWORK CARD

FIELD OF THE INVENTION

The present invention relates to an antenna structure for network card, and more particularly to a retractable antenna for a network card used with a notebook computer. When the computer is not in use or is not connected to a local area network or other type of network, the antenna may be pushed to a retracted position in the network card for the latter to flush with a lateral side of the computer. And, when the computer is to be connected to a network, the antenna may be pushed again to project from the network card and accordingly the lateral side of the computer. The network card can therefore be normally plugged in the notebook computer for convenient use thereof.

BACKGROUND OF THE INVENTION

With the highly developed communication technology, people communicate with one another not only via phones and letters, but also nowadays popular networks. As a result, various kinds of computer peripherals and software for transmission over networks have been successfully developed. People could now see each other or backgrounds of a remote location when they talk over a network, and send e-mails to shorten times that is otherwise needed for communicating via conventional mails and to save a lot of postage. Games provided over networks also create fun to relieve people from pressure and tension.

To connect to a network requires various kinds of hardware. A network card is a bridge between a computer and networks to connect them to one another. There are various types of network cards. FIG. 1 shows a conventional network card 1A designed for use with a notebook computer. The network card 1A includes a main body 10A and an antenna 20A. The antenna 20A is fixedly connected to an end of the main body 10A to extend therefrom. Another end of the main body 10A opposite to the antenna 20A is a terminal for plugging into a network card slot provided on the notebook computer and thereby connecting the network card to the notebook computer, as shown in FIG. 2. With the network card 1A plugged into the notebook computer, the latter can be connected to a network. However, as can be seen in FIG. 2, the network card 1A is plugged into the network card slot provided at one lateral side of the notebook computer with the antenna 20A fixed to an end of the main body 10A of the network card 1 projecting from the lateral side of the notebook computer. When the computer is not in use and to be positioned in a bag, the projected antenna 20A forms a hindrance to convenient storage of the notebook computer. To enable convenient storage of the notebook computer, the whole network card 1A must be removed from the network card slot on the notebook computer and be plugged thereinto again when the computer is to be used next time. Frequent plugging and unplugging of the network card results in easily worn or failed terminal and poor contact of the terminal with the computer. And, the network card removed from the notebook computer for separate storage is easily become lost and a new one must be purchased to adversely increase the user's burden.

It is therefore desirable to develop an improved antenna structure for network card to eliminate the above-mentioned drawbacks.

SUMMARY OF THE INVENTION

A primary object of the present invention is to provide a retractable antenna for a network card used with a notebook computer. The antenna can be pushed to retract in the network card to flush with a lateral side of the notebook computer when the latter is not in use or not to connect to a network. The network card can be normally plugged into the notebook computer to avoid the problems of missing network card and damaged or worn terminal that has adverse influence on the quality of connection of the notebook computer to a network.

Another object of the present invention is to provide a retractable antenna for a network card used with a notebook computer. When the antenna is retracted into a main body of the network card, it is in an open-circuited state to disable connection of the notebook computer to the network, and the whole network card is concealed in a network card slot of the notebook computer. And, when the retracted antenna is pushed again, it is sprung outward to project from the network card slot and is in a close-circuited state to enable connection of the notebook computer to the network.

To achieve the above and other objects, the antenna structure for network card according to the present invention mainly includes a retractable antenna provided in a main body of a network card. The antenna includes a seat fixedly mounted in the main body of the network card, and a sliding member slidably connected to the seat through engagement of channels of the sliding member with rails of the seat.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
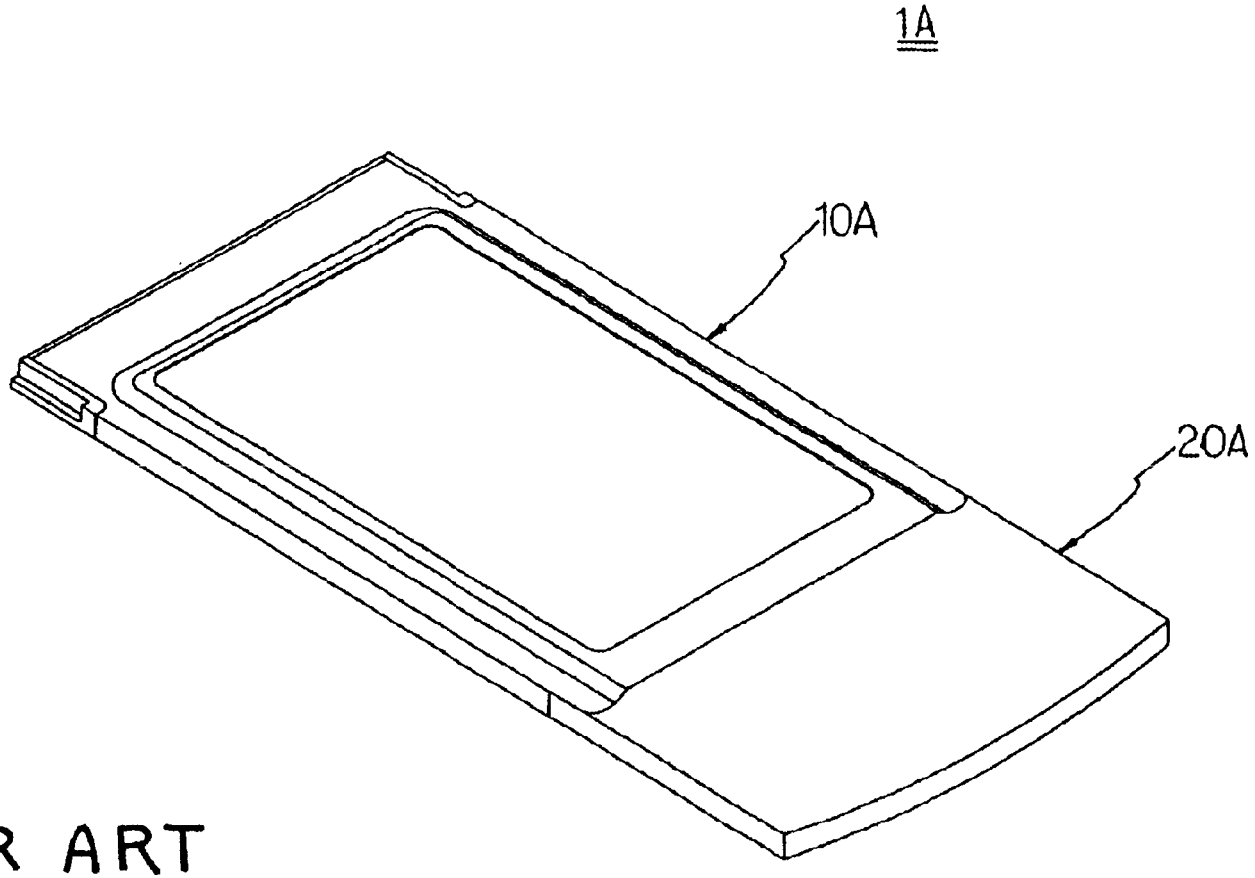
PRIOR ART FIG. 1
FIG. 1 is a perspective view of a conventional network card.
Figure 2:
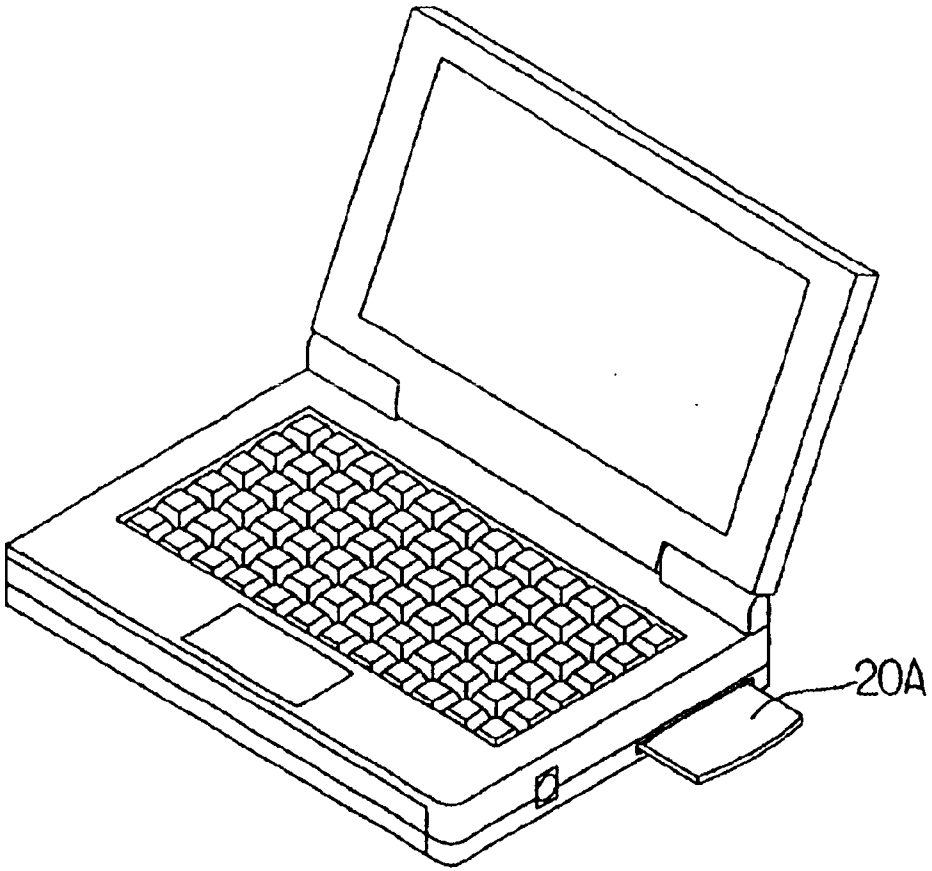
FIG. 2 PRIOR ART
FIG. 2 shows the conventional network card of FIG. 1 being used with a notebook computer.
Figure 3:
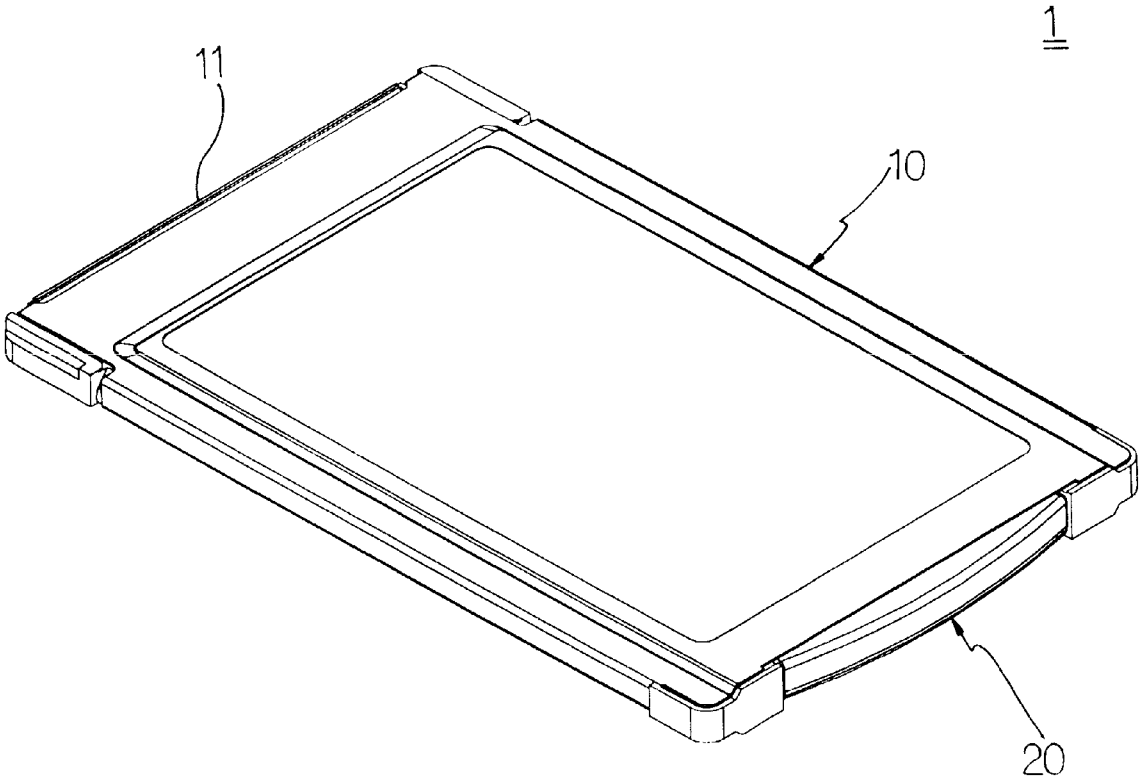
FIG. 3 is a perspective view of a network card incorporating an antenna structure according to the present invention.

Please refer to FIG. 3 that is an assembled perspective view of a network card 1 incorporating an antenna structure of the present invention for use with a notebook computer. As shown, the network card 1 includes a main body 10 having a front end provided with a terminal 11, and an antenna 20 retractably connected to a rear end of the main body 10 opposite to the front end with the terminal 11. When the antenna 20 is pushed to retract into the main body 10, it is in an open-circuited state; and when the retracted antenna 20 is inward pushed for a second time, it is sprung outward to partially project from the rear end of the main body 10 and is in a close-circuited state to enable reception and emission of signals as well as connection of the notebook computer using the network card 1 to a network.

Figure 4:
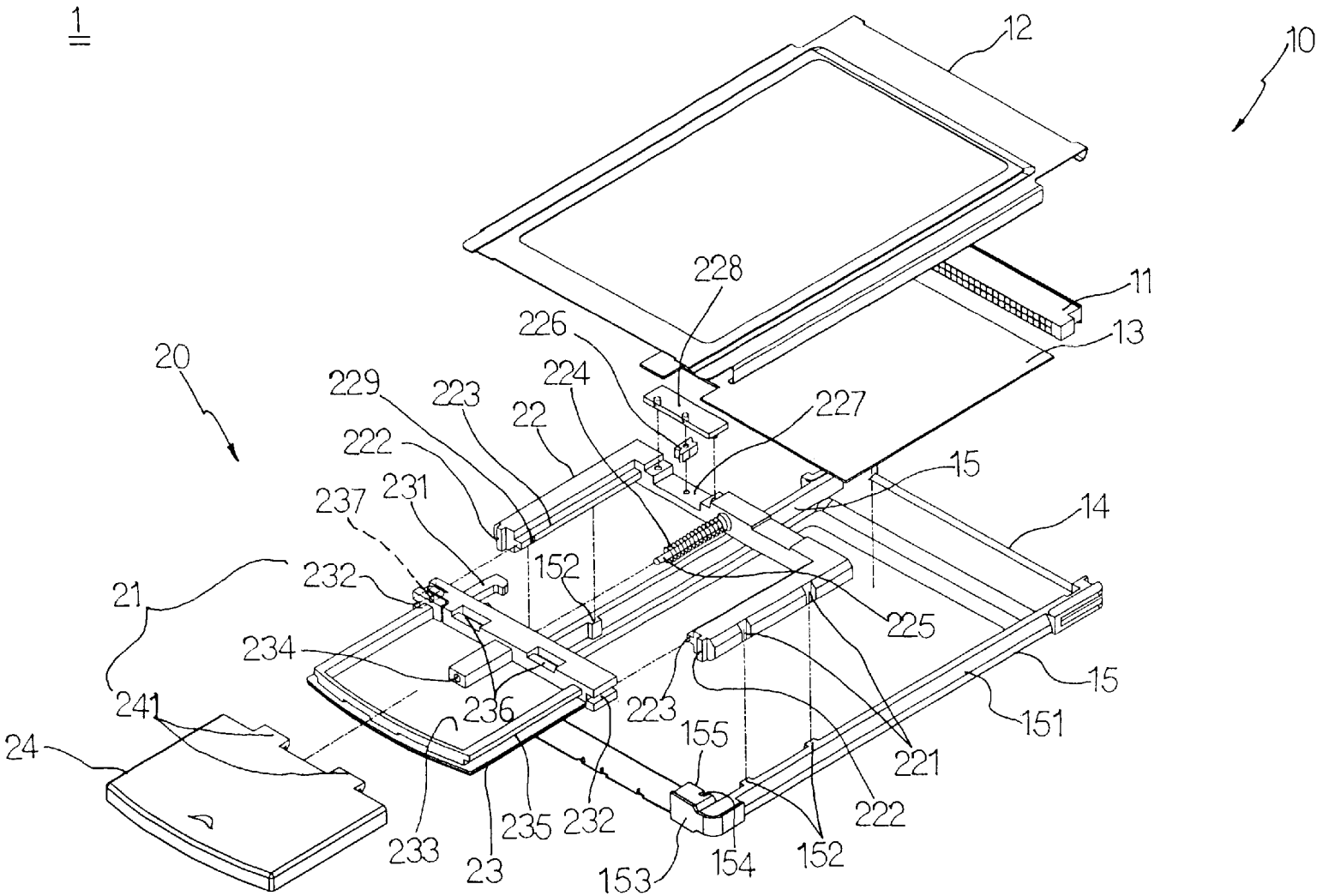
FIG. 4 is an exploded perspective view of FIG. 3.

Please now refer to FIG. 4 that is an exploded perspective view of the network card 1 of FIG. 3. As shown, the main body 10 of the network card 1 includes a terminal 11, an upper case 12, a circuit board 13, and a carrier 14. The terminal 11 is fitted between front ends of two edge members 15 fixedly attached to two lateral sides of the carrier 14 with an inner side of the terminal 11 facing toward the main body 10 welded to the circuit board 13, which is then generally centered between the two edge members 15 of the carrier 14. The two edge members 15 of the carrier 14 are two symmetrical L-shaped members including a long part 151 and a short part 153. The long part 151 of each edge member 15 is provided along an inner surface with spaced front and rear protrusions 152. The short parts 153 are fixedly connected to two outer ends of a rear side of the carrier 14 and are provided at respective inner surfaces facing toward the main body 10 with two notches 154.

The antenna 20 includes a sliding member 21 and a generally n-shaped seat 22 having two lateral bars and a middle bar. Each lateral bar of the seat 22 is provided along an outer surface with spaced front and rear sockets 221 corresponding to the front and rear protrusions 152 on the long part 151 of each edge member 15, and at a rear end surface with a rib 222 corresponding to the notch 154 on the short part 153 of each edge member 15. By engaging the sockets 221 with the protrusions 152 and the ribs 222 with the notches 154, the seat 22 is fixedly located in the carrier 14. The two lateral bars of the seat 22 are also provided along respective inner surfaces with two symmetric rails 223 projected toward each other, and at a middle point of the middle bar with rearward extended middle rod 225 for holding a spring 224 thereon.

The middle bar of the seat 22 is provided at a predetermined position with an open-topped recess 227. A wheel 226 having two symmetrically curved projections provided at two opposite sides is mounted in the recess 227 by engaging a post downward extended from a lower side of the wheel 226 with a hole provided in the recess 227. A holding-down plate 228 is connected to the recess 227 to prevent the wheel 226 from separating from the recess 227 by engaging posts provided at a lower side of the holding-down plate 228 with two holes correspondingly provided at two outer ends of the recess 227 and a hole provided at an upper side of the wheel 226.

The sliding member 21 includes an upper decorative cover 24 and a lower carrier 23. The lower carrier 23 is provided at a front edge facing toward the seat 22 with a forward extended retaining arm 231 corresponding to the wheel 226, and at two lateral end surfaces of the front edge with two channels 232 corresponding to the rails 223 on the seat 22. The lower carrier 23 defines a receiving space 233 therein. A long bar having a central passage 234 is projected from the front edge of the lower carrier 23 into the receiving space 233. The lower carrier 23 is connected to the seat 22 by engaging the channels 232 with the rails 223 on the seat 22 and the central passage 234 with the middle rod 225. To avoid unwanted separation of the lower carrier 23 from the seat 22 and the carrier 14, the front edge of the lower carrier 23 has two outer ends adapted to abut against two stoppers 155 formed at outer ends of the two short parts 153 of the L-shaped edge members 15 of the carrier 14 when the lower carrier 23 is at an outward sprung position relative to the seat 22. A reception and emission circuit (not shown) is provided in the receiving space 233 of the lower carrier 23, which is then closed with the upper decorative cover 24 to show a beautified appearance.

The upper decorative cover 24 is connected to the lower carrier 23 by engaging two retaining hooks 241 provided at a front edge of the cover 24 with two retaining sockets 236 provided at the front edge of the lower carrier 23, and two rails (not shown) provided at two inner lateral surfaces of the cover 24 with two guiding channels 235 provided at two lateral edges of the lower carrier 23.

The upper case 12 of the main body 10 is then closed onto a top of the carrier 14 to complete a network card 1 having a retractable antenna 20.

For the antenna 20 to retractably connected to the main body 10 and to control the open and close of a circuit between the antenna 20 and the circuit board 13, the n-shaped seat 22 is provided at one of the two rails 223 with a first metal contact 229 that is connected to the circuit board 13, and the lower carrier 23 of the sliding member 21 is provided at one of the two channels 232 closer to the first metal contact 229 with a second metal contact 237, which is also connected to the circuit board 13.

Figure 5A:
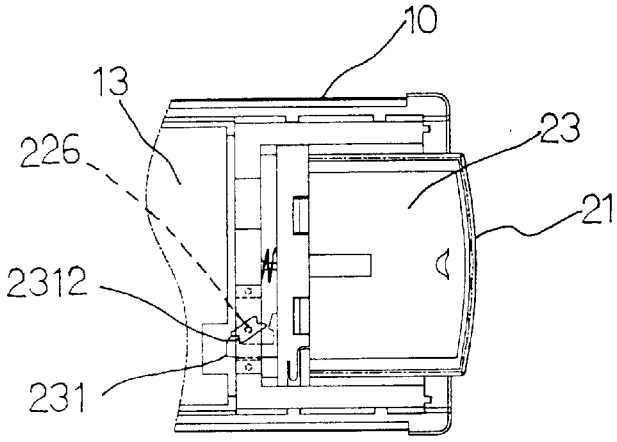
FIGS. 5*a*, 5*b*, and 5*c* are plan views showing the manner in which the antenna structure of the present invention is moved into and out of the network card.
Figure 5B:
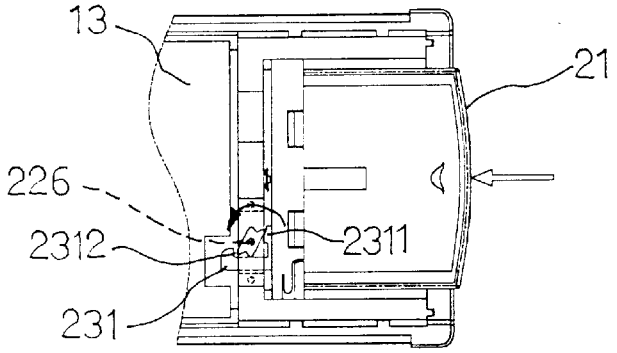
Figure 5C:
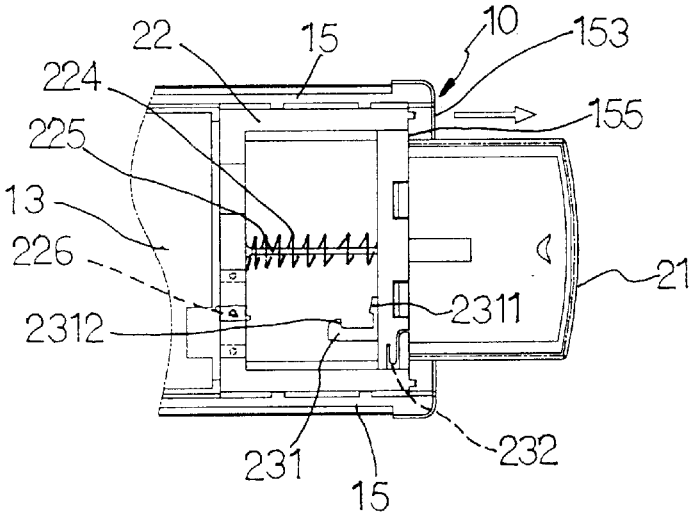

Please refer to FIG. 5*a*. When the sliding member 21 is at a retracted position in the main body 10, the antenna 20 is open-circuited, and a hooked head 2312 of the retaining arm 231 forward extended from the front edge of the lower carrier 23 hooks to and presses against a notch on the wheel 226 at an angle about 90 degrees. When the sliding member 21 is further pushed into the main body 10, as shown in FIG. 5*b*, a protuberance 2311 provided on a base section of the retaining arm 231 is caused to move forward and press against a first one of the two opposite curved projection of the wheel 226 opposite to the notch to which the retaining arm 231 hooks, causing the wheel 226 to turn counterclockwise and accordingly disengage the notch from the hooked head 2312 of the retaining arm 231. At this point, the second curved projection on the wheel 226 close to the hooked head 2312 of the retaining arm 231 is turned to locate at an inner side of the hooked head 2312. Please refer to FIG. 5*c*. When the retaining arm 231 is disengaged from the wheel 226, the sliding member 21 is immediately pushed rearward by the spring 224 on the middle rod 225 at the front middle point of the seat 22 to project from a rear edge of the main body 10. With a tension of the spring 224, the hooked head 2312 of the retaining arm 231 moving rearward further turns the wheel 226 counterclockwise, so that the wheel 226 is finally oriented to be in parallel with the retaining arm 231. When the sliding member 21 is at the rearward projected position, the antenna 20 is in a close-circuited state, and two front lateral ends of the lower carrier 23 having the channels 232 are abutted against the stoppers 155 of the short parts 153 of the two edge members 15 of the carrier 14, preventing the sliding member 21 from completely moving out of the seat 22.

When a user pushes the rearward projected sliding member 21 again, the protuberance 2311 on the base section of the retaining arm 231 is caused to press against the first curved projection at one side of the wheel 226, and the wheel 226 is turned counterclockwise until the notch on the wheel 226 opposite to the first curved projection is engaged with the hooked head 2312 of the retaining arm 231 at an angle about 90 degrees to hold the sliding member 21 at the retracted position in the main body 10, as shown in FIG. 5*a*. The antenna 20 is now in an open-circuited state again.

Figure 6:
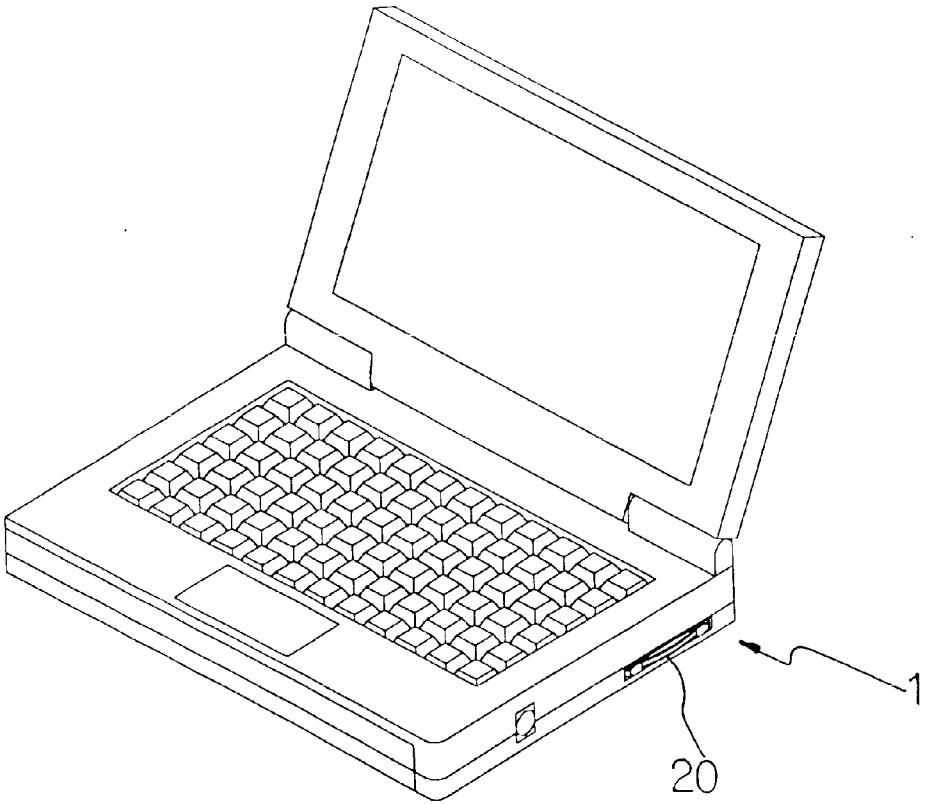
FIG. 6 shows the network card of FIG. 3 being used with a notebook computer.

Please refer to FIG. 6 that shows the network card 1 is used with a notebook computer. When the notebook computer is used without being connected to a network, the antenna 20 is pushed to retract into the main body 10 and becomes open-circuited, and enables the whole network card 1 to conceal in the notebook computer. The user needs not to remove the network card 1 from the notebook computer when the latter is not in use and is to be put into a computer bag, and thereby avoids the problems of missing network card as well as damaged and poor-contacting terminal of the network card due to frequent plugging and unplugging of the network card 1 into and from the computer. That is, the network card 1 incorporating the antenna structure of the present invention can be normally plugged in a network card slot on the notebook computer to advantageously prolong its usable life.

The present invention has been described with a preferred embodiment thereof and it is understood that many changes and modifications in the described embodiment can be carried out without departing from the scope and the spirit of the invention as defined by the appended claims.

What is claimed is:

1. An antenna structure for network card, comprising a network card and an antenna;

said network card including a main body that further includes a terminal, an upper case, a circuit board, and a carrier, and being characterized in that said carrier are provided at two lateral sides with two symmetric L-shaped edge members to each include a long part and a short part; said long parts being provided along respective inner surfaces with spaced front, and rear protrusions, and said short parts being fixedly connected to two outer ends of a rear side of said carrier and provided at respective inner surfaces facing toward said main body with two notches; and said antenna including a sliding member and a seat;

said seat being a generally n-shaped member having two lateral bars and a middle bar, each of said lateral bars being provided along an outer surface with spaced front and rear sockets corresponding to said front and rear protrusion is on said long part of each said edge member on said carrier of said network card, and at a rear end surface with a rib corresponding to said notch on said short part of each said edge member; said seat being fixedly located in said carrier of said main body of said network card through engagement of said front and rear sockets on said seat with said front and rear protrusions on said carrier, and said ribs on said seat with said notches on said edge members of said carrier; said two lateral bars of said seat being also provided along respective inner surfaces with two symmetric rails projected toward each other, and at a middle point of said middle bar with a rearward extended middle rod for holding a spring thereon;

said middle bar of said seat being provided at a predetermined position with an open-topped recess, and a wheel having two symmetric and opposite curved projections being rotatably located in said recess by engaging a post downward extended from a lower side of said wheel with a hole provided in said recess; and said wheel being prevented from separating from said recess by connecting a holding-down plate to said recess through engagement of posts provided at a lower side of said holding-down plate with two holes correspondingly provided at two outer ends of said recess and a hole provided at an upper side of said wheel; and said sliding member including an upper decorative cover and a lower carrier; said lower carrier being provided at a front edge facing toward said seat with a forward extended retaining arm corresponding to said wheel on said seat, and at two lateral end surfaces of the front edge with two channels for engaging with said rails on said seat; said lower carrier defining a receiving space therein, and a long bar having a central passage being projected from the front edge into said receiving space; said lower carrier being connected to said seat through engagement of said channels at two lateral end surfaces of the front edge with said rails on said seat, and said central passage with said middle rod on said seat;

said front edge of said lower carrier having two outer ends adapted to abut against two stoppers formed at outer ends of said short parts of said L-shaped edge members of said carrier to avoid unwanted separation of said lower carrier from said seat and said carrier; and said upper decorative cover being connected to said lower carrier through engagement of two retaining hooks provided at a front edge of said upper decorative cover with two retaining sockets provided at the front edge of said lower carrier, and two rails provided at two inner lateral surfaces of said upper decorative cover with two guiding channels provided at two lateral edges of said lower carrier;

whereby said antenna is retracted into said main body of said network card by pushing said sliding member forward to engage said retaining arm of said sliding member with said rotatable wheel on said seat, and is rearward projected from said main body by pushing said retracted sliding member again to disengage said retaining arm from said rotatable wheel.

2. The antenna structure for network card as claimed in claim 1, wherein said n-shaped seat of said antenna is provided at one of said two rails with a first metal contact that is connected to said circuit board, and said lower carrier of said sliding member is provided at one of said two channels closer to said first metal contact with a second metal contact, which is also connected to said circuit board, whereby said antenna is in an open-circuited state when said sliding member is at the retracted position in said main body of said network card, and is in a close-circuited state when said sliding member is at the projected position out of said main body of said network card.

* * * * *